US006966068B2

(12) United States Patent
Johnson et al.

(10) Patent No.: US 6,966,068 B2
(45) Date of Patent: Nov. 22, 2005

(54) SWIM CAP

(75) Inventors: Ronald Johnson, Scottsdale, AZ (US); David E. Calapp, Bellingham, WA (US); Matthew A. Rhoades, Morgan Hill, CA (US)

(73) Assignee: Aero Tech Sports Corporation, Bellingham, WA (US)

( * ) Notice: Subject to any disclaimer, the term of this patent is extended or adjusted under 35 U.S.C. 154(b) by 0 days.

(21) Appl. No.: 10/879,465

(22) Filed: Jun. 29, 2004

(65) Prior Publication Data

US 2004/0261153 A1 Dec. 30, 2004

Related U.S. Application Data

(60) Provisional application No. 60/483,607, filed on Jun. 30, 2003.

(51) Int. Cl.[7] ..... A42B 1/12
(52) U.S. Cl. ..... 2/68; 2/200.2
(58) Field of Search ..... 2/68, 10, 67, 174, 2/200.2, 261

(56) References Cited

U.S. PATENT DOCUMENTS

| | | | | |
|---|---|---|---|---|
| 4,146,932 | A * | 4/1979 | Kalbas | 2/68 |
| 4,817,212 | A * | 4/1989 | Benoit | 362/106 |
| 5,095,545 | A | 3/1992 | Lane | |
| 5,349,702 | A | 9/1994 | Runckel | |
| 6,085,359 | A | 7/2000 | Viola | |

* cited by examiner

*Primary Examiner*—John J. Calvert
*Assistant Examiner*—Brian Kauffman
(74) *Attorney, Agent, or Firm*—Christensen, O'Connor, Johnson, Kindness PLLC

(57) ABSTRACT

A semirigid swim cap (100) is disclosed, having a unitary construction. The swim cap is generally open at the bottom and includes a forward edge (104), a rearward edge (106), oppositely disposed ear cover portions (108), and a center portion (101). In a preferred embodiment, the swim cap is made from an elastomeric thermoplastic and the center portion is relatively thick, while the peripheral edge portions are relatively thin and therefore less rigid. A pair of sealing ridges (110) extends from an inner surface of the swim cap, near the open bottom.

25 Claims, 6 Drawing Sheets

SWIM CAP

CROSS-REFERENCE TO RELATED APPLICATION

This application claims the benefit from U.S. application Ser. No. 60/483,607, filed Jun. 30, 2003, which is hereby incorporated herein by reference.

FIELD OF THE INVENTION

The present invention is directed to swimwear and, in particular, to swim caps that are suitable to use in competitive swimming.

BACKGROUND OF THE INVENTION

Many swimmers use swimming caps to cover their heads during swimming. Swimming caps generally cover the upper portion of the swimmer's ears and contain the swimmer's hair during swimming. In competitive swimming where winning margins are often measured in hundredths of a second, a swim cap may be particularly important for reducing the hydrodynamic drag on the swimmer. A conventional swim cap covers the crown of a swimmer's head, a portion of the swimmer's forehead and the ears, and the upper portion of the nape of the neck. The wearer's hair is generally tucked inside the cap during use.

Conventional swim caps are typically generally hemispherical in shape and are made from a relatively thin, pliant, stretchable, and resilient material, such as a manmade fabric (e.g., spandex), silicone, or latex. Silicone and latex are convenient materials for swim caps due to their relative toughness, flexibility, and easy manufacturability. The pliability of the conventional swim cap is particularly important when the swimmer is engaging in strokes requiring a high degree of arch in the back and neck, such as the butterfly stroke, so that the swim cap does not interfere when the swimmer's neck is arched back.

A disadvantage of conventional swim caps, however, is that the upper portion of the swim cap tends to deform during use, forming transverse wrinkles, particularly over the crown of the swimmer's head. These transverse wrinkles result from a variety of factors, including the highly flexible and stretchable materials used to form the swim cap, the swimmer's hair enclosed by the swim cap, the motion of the swimmer's head and neck, and hydrodynamic and other forces acting on the swim cap during entry into the water and swimming. The transverse wrinkling reduces the efficiency of the swimmer by increasing the hydrodynamic drag as the water flows about the swim cap. In addition, during use a conventional swim cap typically covers only the upper portion of the swimmer's ears, leaving a portion of the ears in the flow stream.

It would therefore be beneficial to provide a swim cap that adequately covers portions of the swimmer's head and hair, including all of the swimmer's ears, but that does not tend to form wrinkles or otherwise deform to reduce the efficiency of the swimmer in the water.

SUMMARY OF THE INVENTION

A novel swim cap is disclosed that fits over the head of the swimmer, generally conforming to the head, and that will not produce transverse wrinkles during use. The swim cap is made from an elastomeric polymer and fits over the swimmer's head. The swimmer dons the swim cap through the relatively elastic open lower periphery. The stiffness of the swim cap varies from more firm at a center portion to less firm and more flexible along the lower portion. The swim cap is elastically retained on the swimmer's head.

In an embodiment of the invention, the variable stiffness is accomplished, at least in part, by varying the thickness of the swim cap, decreasing from a maximum thickness at the center portion to thinner at the edges.

In an embodiment of the invention, the swim cap maximum thickness is about 0.125 inch, and the swim cap minimum thickness is between about 0.05 and 0.06 inch.

In an embodiment of the invention, the rearward edge of the swim cap curves upwardly from the ear cover portions so that the swim cap does not cover the back of the neck of the swimmer and, therefore, the swim cap does not interfere with the swimmer during strokes requiring a high degree of back and neck arch.

In an embodiment of the invention, a pair of sealing ridges is provided about the inside periphery of the swim cap near the open lower periphery to deter water from entering the swim cap during use.

In an embodiment of the invention, the swim cap is formed as a single piece and made from a thermoplastic polyurethane having a Shore A hardness between about 60 and 80.

BRIEF DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION OF THE PREFERRED EMBODIMENT

A currently preferred embodiment of the present invention will now be described in detail, with reference to the figures, to describe and illustrate various aspects and advantages of the present invention.

Figure 1:
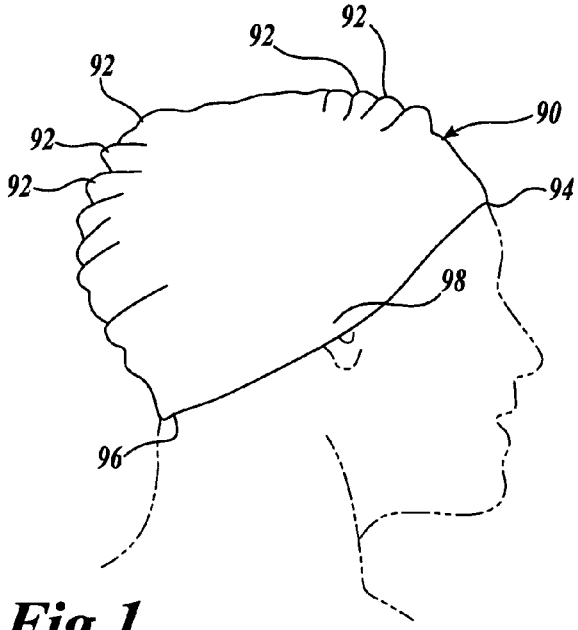
Fig.1. (PRIOR ART)
FIG. 1 shows a conventional pliable swim cap, on the head of a swimmer, showing the wrinkles that typically form in the swim cap.

FIG. 1 shows a conventional swim cap 90 on the head of a swimmer. The swim cap 90 substantially covers the swimmer's hair and ears, extending from a forward edge 94 at the swimmer's forehead to a rearward edge 96 at the swimmer's neck. The ear portions 98 typically cover an upper portion of the swimmer's ears. In fact, typically during use a conventional swim cap will tend to slip off portions or all of the swimmer's ears. A number of transverse wrinkles 92 are formed on the top of the swim cap 90. These wrinkles 92 are very typical for conventional swim caps 90 and generally form due to the very pliable nature of the material used in conventional swim caps 90. The wrinkles 92 may be caused by a variety of factors, acting in combination or alone, including the forces incurred when entering the water, hydrodynamic forces, motion of the swimmer's head and neck, and the swimmer's hair inside the swim cap 90. It will be appreciated that during swimming the wrinkles 92 are generally transverse to the water flow direction and substantially at the leading edge of the swimmer's head and, therefore, are oriented and positioned to produce significant drag for a competitive swimmer.

Figure 2A:
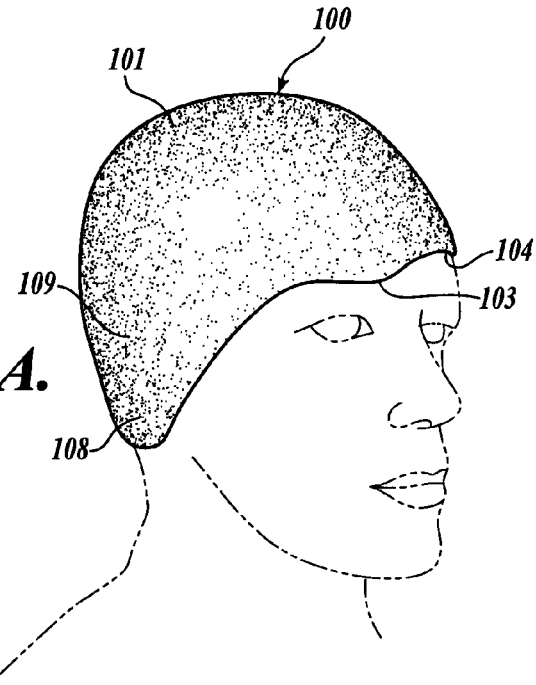
FIGS. 2A and 2B show a swim cap made in accordance with the present invention, on the head of a swimmer, with FIG. 2A showing a three-quarter front view and FIG. 2B showing a three-quarter rear view.
Figure 2B:
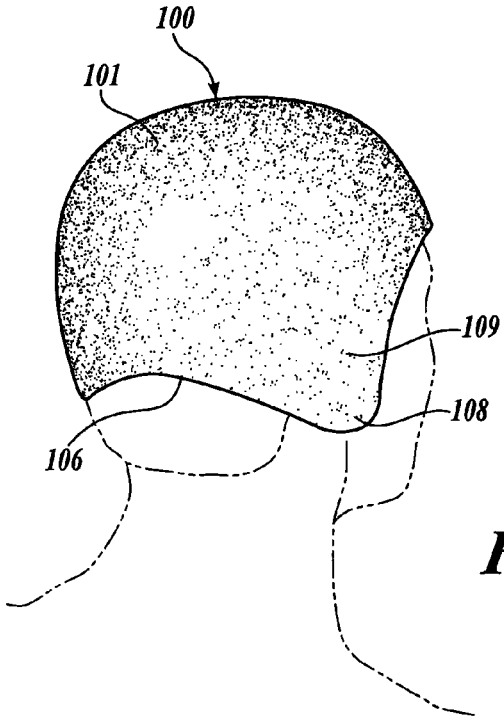

FIGS. 2A and 2B show a swim cap 100 made in accordance with the present invention. The swim cap 100 is sufficiently pliable to generally conform to the user's head. It is open at the bottom and adapted to elastically fit over the head of a swimmer. The swim cap 100 has a forward edge 104 that extends over the swimmer's forehead, a rearward edge 106 that extends generally to the base of the crown of the swimmer's head, and oppositely disposed ear cover portions 108. In a preferred embodiment, the forward edge 104 is contoured, with a middle edge portion 103 that extends further down the swimmer's forehead to provide a comfortable fit while aiding in keeping the swim cap 100 in place during use and, in particular, when diving into the water. Left and right ear cover portions 108 (only the right ear cover portion is visible in FIGS. 2A and 2B) are adapted to extend completely over the swimmer's ears. It will be appreciated that the ear cover portions 108 include a gently sloping raised or concave (from the inside) portion 109 to form an interior volume to accommodate the swimmer's ears. However, because the swim cap 100 is formed from a relatively stiff material, the general external shape of the raised portion 109 will maintain a smooth, gradual contour to allow a smooth water flow transition, thereby improving hydrodynamic flow and reducing drag (relative to the conventional swim cap shown in FIG. 1).

As seen most clearly in FIG. 2B, the rearward edge 106 of the swim cap 100 curves upwardly from the ear cover portions 108 approximately to the occipital bone of the swimmer's head, such that the swim cap 100 does not overlie the back of the swimmer's neck.

Many swimming strokes require significant head movement and, in particular, may require the swimmer to periodically raise his or her head sharply at a substantial rearward angle. This backward head motion is easily accommodated by the pliability of the conventional swim cap 90 shown in FIG. 1. The swim cap 100 of the present invention, however, is relatively stiff. Due to the relative stiffness of the swim cap 100, such backward movement of the head might tend to dislodge the swim cap 100 from the swimmer's head, particularly after a number of repetitions of the stroke, if the rearward edge 106 of the swim cap 100 extended over the swimmer's neck. The upwardly curving rearward edge 106 will prevent the swim cap 100 from interfering with or being pushed by the swimmer's neck and/or back when the swimmer is engaged in activities that requires a rearward arching of the back and neck.

It will also be appreciated by the artisan that the shape of the rearward edge 106 also increases the overall flexibility of the swim cap 100 so that it is easier for the swimmer to put on and take off. As discussed with reference to FIG. 8 below, the swim cap 100 is generally elastically stretched and deformed to facilitate donning and removing the swim cap 100. Moreover, it is contemplated that the rearward edge 106 may optionally include one or more longitudinal channels, reduced thickness sections, or even slits (not shown) that extend generally from the rearward edge 106 toward the center portion 101. Such longitudinal channels or slits would further increase the elasticity of the rearward edge 106 (and neighboring portions) of the swim cap 100, if desirable—for example, to make the swim cap 100 easier to put on and take off.

The swim cap 100 is shaped to generally conform to the head of the swimmer and is sufficiently elastic that a properly sized and donned swim cap 100 will be elastically deformed, such that the force from the elastic deformation will retain the swim cap 100 on the head of the swimmer during its intended use. Although the disclosed swim cap 100 is shown without a retaining chinstrap, it is contemplated that a retaining strap could be provided (and in some applications may be preferred) including a fastening element, such as a hook-and-loop type material, without departing from the present invention.

In a currently preferred embodiment of the swim cap 100, the swim cap 100 is made from a thermoplastic polyurethane. The currently preferred polyurethane has a Shore A durometer hardness of between about 60 and 80. It will be immediately apparent to those of skill in the art, however, that other semirigid materials having sufficient flexibility and durability in water may alternatively be used—including, for example, other elastomeric thermoplastic or thermoset materials—and are contemplated by the present invention. An advantage of using elastomeric thermoplastics is that the swim cap 100 may conveniently be manufactured using well-known molding techniques such as injection molding or the like. Other molding techniques, for example various casting methods or transfer molding techniques may alternatively be used. In the preferred embodiment the swim cap 100 is of unitary construction from a single material having a specific gravity greater than 1.0.

The outer surface of the swim cap 100 is optionally textured in order to decrease the hydrodynamic drag. It is known that the hydrodynamic drag characteristics of an object moving though water may be decreased by texturing the surface of the object. The characteristic dimension of the texturing may be optimized, for example, for a particular swimming speed.

As discussed above, the swim cap 100 must have sufficient rigidity that the swim cap 100 will resist forming wrinkles during its intended use while being of sufficient flexibility that the swimmer can flex the swim cap 100 to elastically fit over the swimmer's head. An additional consideration is that if the swim cap 100 is too flexible, it may come off of the swimmer during use. Therefore, the swim cap 100 approximately conforms to the head of the swimmer such that the elastic forces exerted by the swim cap 100, when on the swimmer's head, will prevent the anticipated hydrodynamic and other forces experienced during swimming from causing the swim cap 100 come off.

Figure 3:
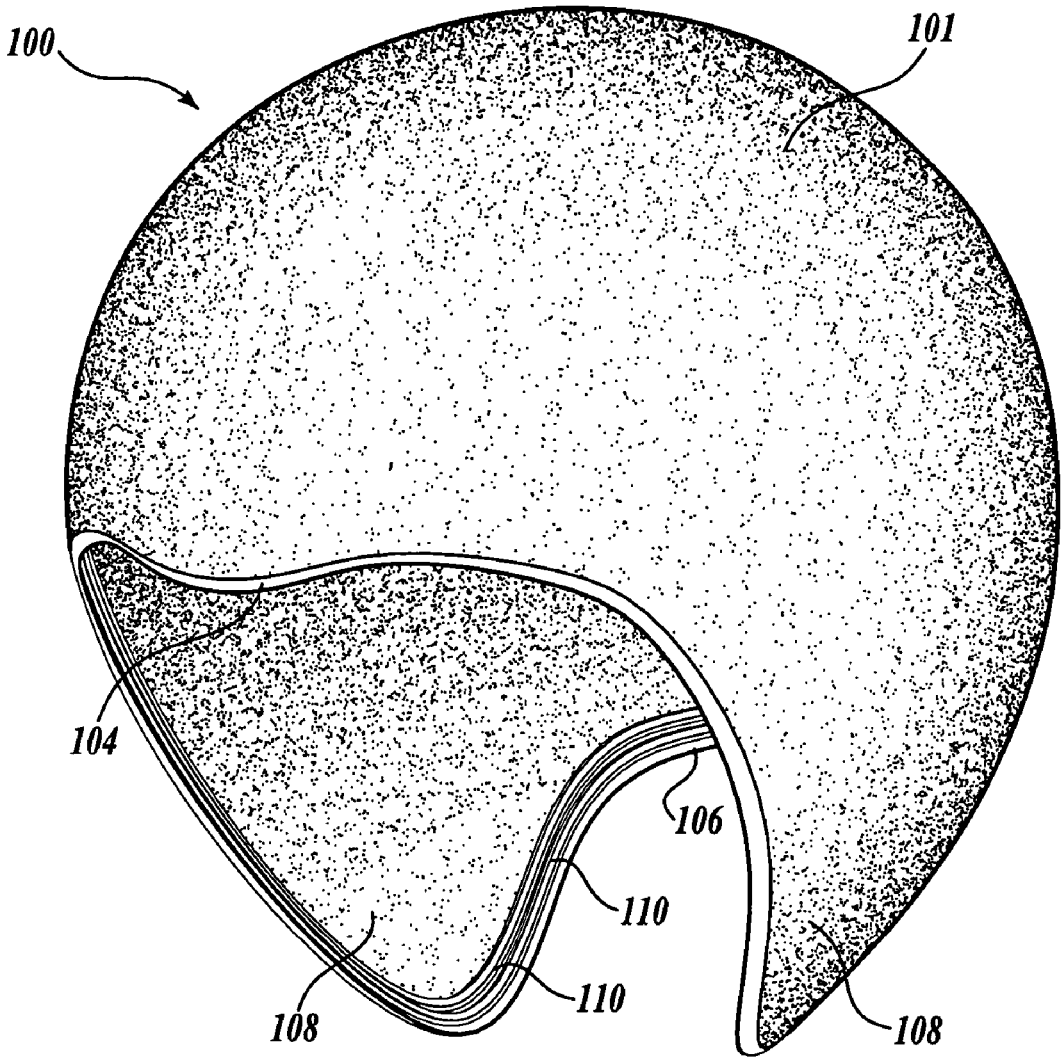
FIG. 3 shows a three-quarter front perspective view of the swim cap shown in FIG. 2A.

FIG. 3 shows a three-quarter perspective view of the swim cap 100 shown in FIGS. 2A and 2B, not being worn by a swimmer. When the swim cap 100 is not worn, i.e., unflexed, the swim cap 100 is not deflected by the swimmer's head—and so, for example, the left and right ear cover portions 108 are closer together (see also, FIG. 8).

It has been found that the desired stiffness properties for the swim cap 100 can be accomplished by varying the stiffness of the swim cap 100 from generally stiffer at a center portion 101 of the swim cap 100 to less stiff near the edges 104, 106 and ear cover portions 108. The desired variation in stiffness can be conveniently accomplished, for example, by varying the thickness of the swim cap 100 from being thicker near the center portion 101 to thinner near the edges 104, 106 and the ear cover portions 108. Alternatively, the variation in stiffness over the swim cap may be achieved by altering the geometry—for example, by including strategically-placed longitudinal ridges or channels, or by varying the material properties in different areas of the swim cap. For example, a particular thermoplastic may be fabricated with higher or lower durometer characteristics by well-known methods.

Figure 4:
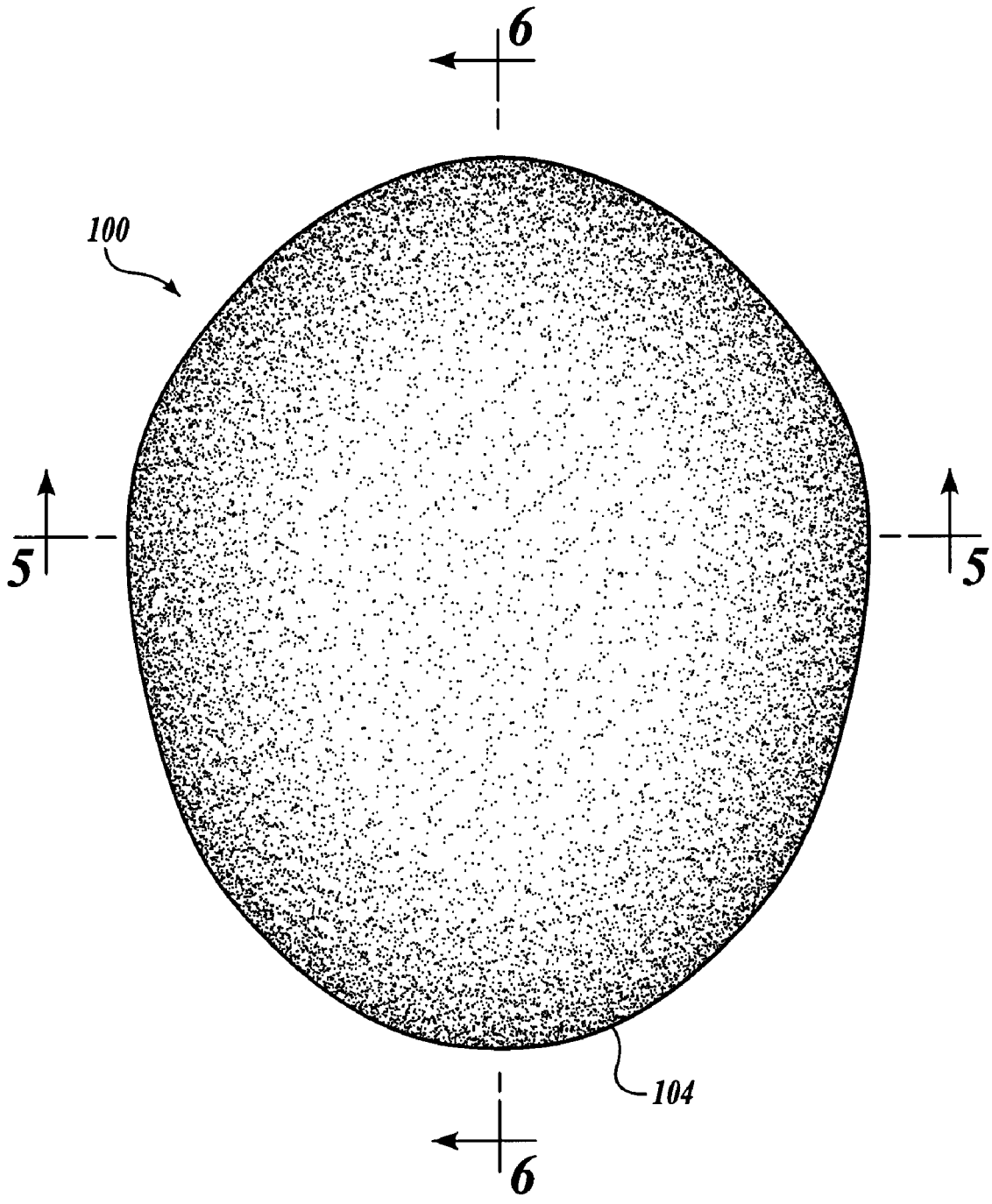
FIG. 4 shows a top view of the swim cap shown in FIG. 3.
Figure 5:
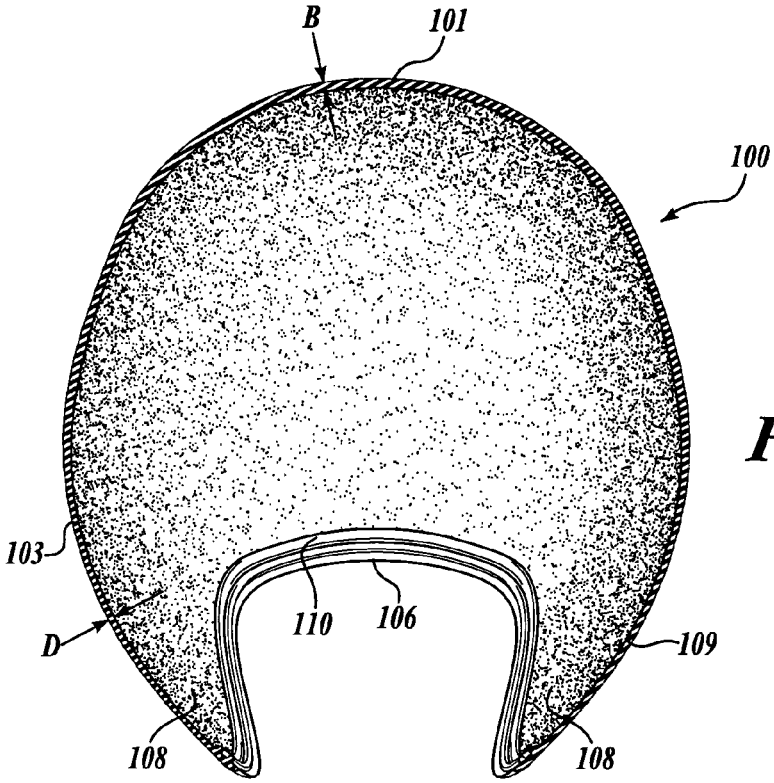
FIG. 5 shows a cross-section of the swim cap shown in FIG. 4 taken along cut line 5—5 of FIG. 4.
Figure 6:
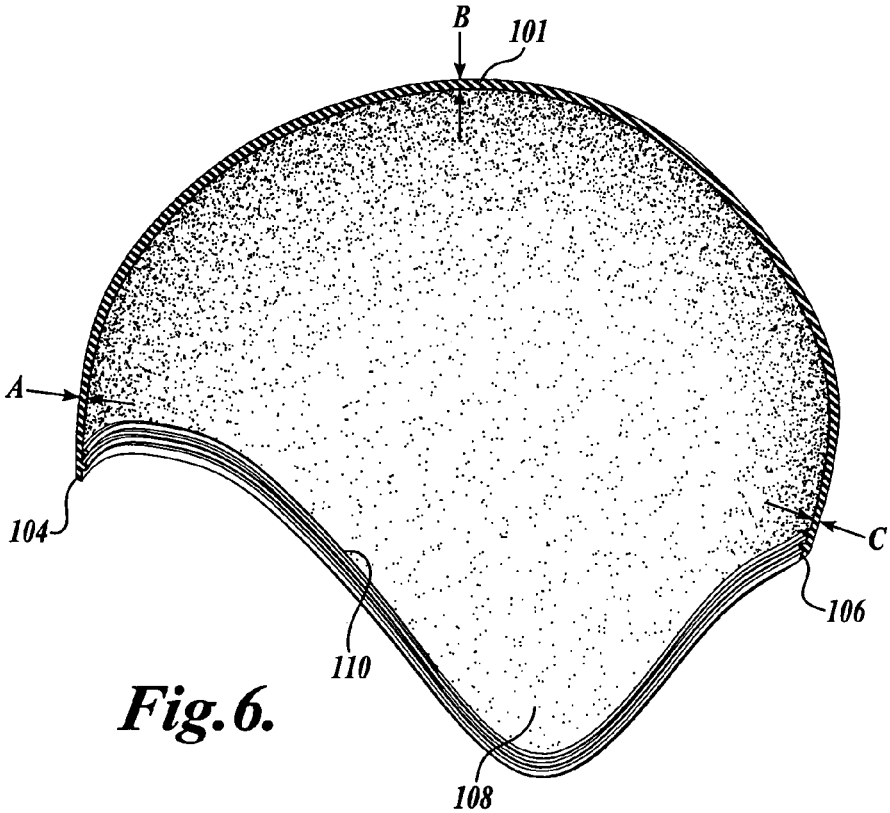
FIG. 6 shows a cross-section of the swim cap shown in FIG. 4, taken along cut line 6—6.
Figure 7:
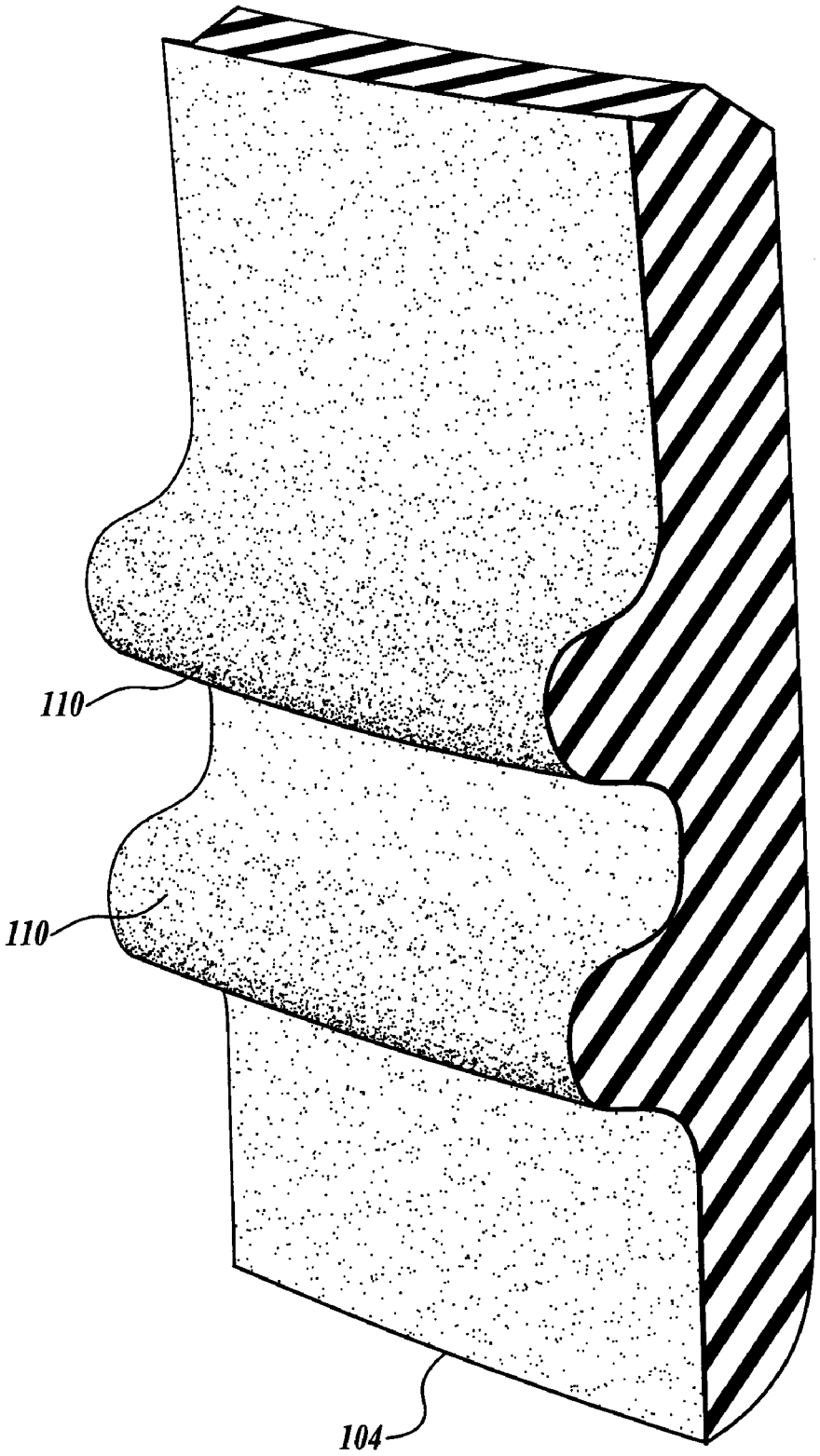
FIG. 7 shows a close-up fragmentary view of a cross-section of the swim cap shown in FIG. 4 near the ear flaps.

FIG. 4 shows a top view of the swim cap 100 with section line 5—5 indicating a transverse section and section line 6—6 indicating a longitudinal section. FIG. 6 shows a cross-section of the swim cap 100 taken through section line 6—6 of FIG. 4. The swim cap 100 has a wall thickness "A" near the forward edge 104, a wall thickness "B" at the center portion 101, and a wall thickness "C" near the rearward edge 106. The wall thickness "B" at the center portion 101 is greater than wall thicknesses "A" and "C" at the forward edge 104 and rearward edge 106, respectively. In a currently preferred embodiment utilizing a thermoplastic polyurethane, the maximum wall thickness "B" is about 0.125 inch, the minimum thickness "A" near the forward edge 104 is about 0.06 inch, and the minimum thickness "C" near the rearward edge 106 is about 0.05 inch. Similarly, FIG. 5 shows a cross-section of the swim cap taken through section line 5—5 of FIG. 4 and showing the wall thickness "D" near the edge of the ear cover portions 108. In the currently preferred embodiment, the minimum wall thickness for the ear cover portions 108 is about 0.06 inch. The wall thickness preferably varies smoothly between the maximum thickness and the minimum thickness.

The optimal wall thickness variation will, of course, depend on several factors, such as the properties of the material that is selected for the swim cap, the specific shape and size of the swim cap, and perhaps even the particular application, e.g., particular swimming or diving style that the swim cap will be used for and the preferences of the swimmer. It will be appreciated, however, that the swim cap 100 has an upper surface that is firm enough to resist deformation (except to the general head shape) and has a graduated stiffness that becomes increasingly elastomeric and flexible as it transitions to the lower sections of the swim cap covering the sides of the head, ears, forehead, and back of the head. It is also contemplated that the desired variation in rigidity may be achieved and/or enhanced through other selective adaptations of the geometry, such as longitudinal grooves or partial slits in the swim cap.

It will now be apparent to the artisan that the periphery of the swim cap 100, that is, the ear cover portions 108 and portions near the forward and rearward edges 104, 106, will be significantly more elastic that the center portion 101. The swim cap 100 can therefore be stretched somewhat to fit over the swimmer's head while retaining optimally greater rigidity over the center portion 101, thereby retaining the generally streamlined shape of the swimmer's head.

Referring again to FIG. 3, in the disclosed embodiment the swim cap 100 includes a pair of sealing ridges 110 that extends continuously about the inside perimeter of the swim cap 100. FIG. 6 shows a fragmentary cross-sectional view of the swim cap 100 at the center of the forward edge 104, illustrating the sealing ridges 110. The sealing ridges 110 are integral with the swim cap 100 and function somewhat similarly to a pair of O-rings to prevent or reduce the tendency of water from entering the swim cap 100 during use. In a currently preferred embodiment, two sealing ridges 110 extend continuously around the edges of the swim cap 100 and are approximately 0.06 inch in height. Although two sealing ridges 110 are shown, it is contemplated that only one or more than two sealing ridges 110 may alternatively be used, and/or that the sealing ridges may not extend around the entire swim cap 100—for example, tapering off near the rearward edge 106. It will be appreciated that preventing water from entering the swim cap is desirable not only to increase the swimmer's comfort, but also to help prevent hydraulic forces from causing the swim cap 100 to loosen or dislodge from the swimmer's head.

Figure 8:
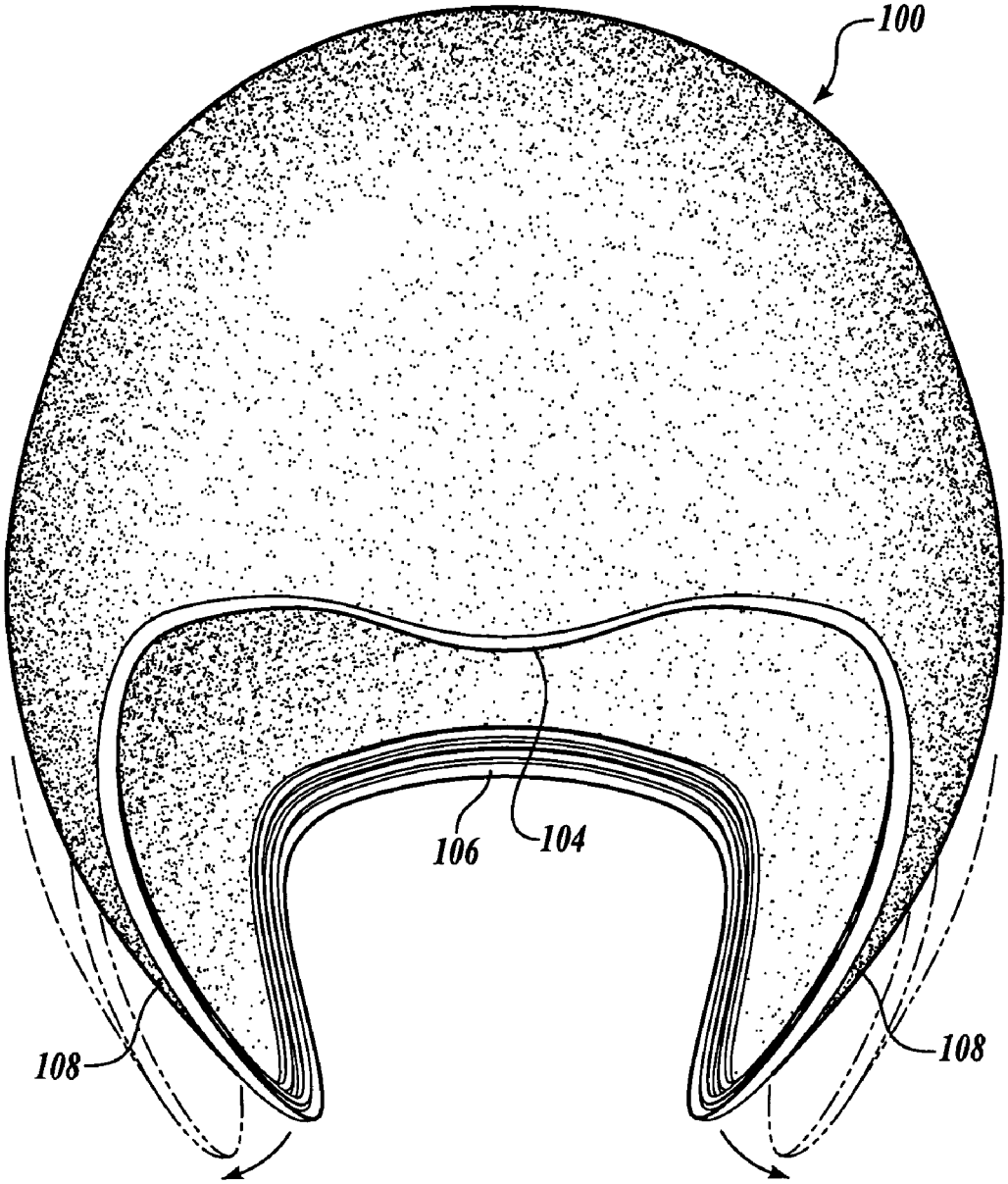
FIG. 8 shows the swim cap of FIG. 3 showing how the swim cap is flexed and/or stretched for donning.

To use the swim cap 100, the swimmer flexes the swim cap 100—for example, by pulling outwardly on the ear cover portions 108, as indicated by the arrows in FIG. 8. The swim cap 100 may then be placed over the swimmer's head and released to provide a secure elastically retained fit about the swimmer's head. It is contemplated that the swim cap 100 may be produced in a number of different sizes with appropriate variations in shape, to provide a comfortable fit for any particular user.

While the preferred embodiment of the invention has been illustrated and described, it will be appreciated that various changes can be made therein without departing from the spirit and scope of the invention.

The embodiments of the invention in which an exclusive property or privilege is claimed are defined as follows:

1. A swim cap comprising an elastomeric member, the elastomeric member being open along a lower periphery and adapted to substantially cover a swimmer's head, the elastomeric member having a center portion, a forward edge, a rearward edge, and a pair of oppositely-disposed ear cover portions, wherein the stiffness of the swim cap decreases from a maximum stiffness at the center portion, the maximum stiffness being sufficient to inhibit the formation of wrinkles, to a lesser stiffness at the forward and rearward edges, and wherein the swim cap is elastically retained on the swimmer's head by the elastomeric member.

2. The swim cap of claim 1, wherein the swim cap has a smoothly varying thickness that decreases from a maximum thickness at the center portion to a first minimum thickness at the forward edge, and from the maximum thickness at the center portion to a second minimum thickness at the rearward edge.

3. The swim cap of claim 2, wherein the maximum thickness is about 0.125 inches and the first minimum thickness is about 0.06 inches.

4. The swim cap of claim 3, wherein the second minimum thickness is about 0.05 inches.

5. The swim cap of claim 1, wherein the swim cap is formed from an injection-moldable thermoplastic polymer.

6. The swim cap of claim 2, wherein the swim cap is formed from a polyurethane having a Shore A durometer hardness between about 60 and 80.

7. The swim cap of claim 1, wherein the swim cap stiffness is varied by varying the elasticity of the material of the elastomeric member.

8. The swim cap of claim 1, wherein the swim cap is formed from a cast molded thermoset polymer.

9. The swim cap of claim 1, wherein the swim cap further comprises a first elongate sealing ridge extending around an inner surface near the lower periphery of the swim cap.

10. The swim cap of claim 9, further comprising a second elongate sealing ridge closely spaced from the first elongate sealing ridge and wherein the first and second sealing ridges are approximately 0.06 inches in height.

11. The swim cap of claim 1, wherein the rearward edge curves upwardly from the ear cover portions.

12. The swim cap of claim 11, wherein the swim cap does not overlie the back of said swimmer's neck.

13. The swim cap of claim 1, wherein the ear cover portions are adapted and sized to completely cover the ears of the swimmer during use.

14. A swim cap for covering the head of a swimmer during swimming, the swim cap comprising a unitary, elastomeric thermoplastic having an open and relatively thin lower portion that is adapted to overlie the ears and forehead of said swimmer, and a relatively thick center portion adapted to overlie the crown of the head of said swimmer.

15. The swim cap of claim 14, wherein the elastomeric thermoplastic is polyurethane.

16. The swim cap of claim 14, wherein the maximum thickness of the center portion is about 0.125 inches and further, wherein the minimum thickness of the lower portion is between about 0.05 inches and 0.06 inches.

17. The swim cap of claim 14, wherein the swim cap further comprises an elongate sealing ridge extending from an inner surface of the lower portion.

18. The swim cap of claim 14, wherein the swim cap has a textured outer surface.

19. The swim cap of claim 14, wherein the swim cap is formed by injection molding.

20. A swim cap formed unitarily from an elastomeric material, the swim cap having an edge portion including a portion adapted to cover a swimmer's forehead, ear cover portions adapted to completely cover the swimmer's ears, a rearward portion adapted to cover the back of the swimmer's head without extending significantly over the swimmer's neck, and a center portion disposed inwardly from the edge portion, wherein the edge portion is more elastic than the center portion.

21. The swim cap of claim 20, wherein the edge portion is adapted to elastically retain the swim cap on the swimmer's head during use.

22. The swim cap of claim 21, wherein the minimum thickness is between about 0.05 inches and 0.06 inches, and wherein the maximum thickness is about 0.125 inches.

23. The swim cap of claim 20, further comprising a sealing ridge extending from an inner surface of the edge portion.

24. The swim cap of claim 20, wherein the swim cap elasticity is varied by varying the elasticity of the material of the elastomeric member.

25. The swim cap of claim 20, wherein the swim cap is formed from a cast molded thermoset polymer.

* * * * *